US008651638B2

(12) United States Patent
Ishikawa

(10) Patent No.: US 8,651,638 B2
(45) Date of Patent: Feb. 18, 2014

(54) INKJET PRINTING APPARATUS

(75) Inventor: Tetsuya Ishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 13/218,626

(22) Filed: Aug. 26, 2011

(65) Prior Publication Data

US 2012/0050423 A1 Mar. 1, 2012

(30) Foreign Application Priority Data

Aug. 31, 2010 (JP) ..... 2010-194738

(51) Int. Cl.
*B41J 2/175* (2006.01)

(52) U.S. Cl.
USPC ..... 347/86; 347/36; 347/85; 215/232

(58) Field of Classification Search
None
See application file for complete search history.

(56) References Cited

U.S. PATENT DOCUMENTS 5,581,287 A * 12/1996 Baezner et al. ..... 347/85
6,070,975 A * 6/2000 Uchikata et al. ..... 347/86
2004/0201652 A1* 10/2004 Katayama ..... 347/85
2007/0070147 A1* 3/2007 Hattori et al. ..... 347/86
2007/0120901 A1* 5/2007 Sugiyama et al. ..... 347/85

FOREIGN PATENT DOCUMENTS

JP 2006-116784 * 5/2006 ..... B41J 2/175
JP 2008-049640 A 6/2008

OTHER PUBLICATIONS

U.S. Appl. No. 13/217,459, filed Aug. 25, 2011.

* cited by examiner

*Primary Examiner* — Matthew Luu
*Assistant Examiner* — John P Zimmermann
(74) *Attorney, Agent, or Firm* — Fitzpatrick, Cella, Harper & Scinto

(57) ABSTRACT

An inkjet printing apparatus comprises an ink tank including an ink accommodating unit, an ink leading-out mechanism for leading out the ink in the ink accommodating unit to an outside, and a housing, and an ink tank holder for removably retaining the ink tank, wherein a space is formed between the ink leading-out mechanism and the housing, and when the ink tank is mounted to the ink tank holder, an ink flow passage is formed by contact of an outer periphery of an ink leading-out needle in the ink tank holder with a sealing member in the ink leading-out mechanism, further comprising restriction means for restricting a position of the ink tank to the ink tank holder such that when removing the ink tank from the ink tank holder, the ink tank stops in a state where a tip end of the ink leading-out needle is in the space.

9 Claims, 10 Drawing Sheets

INKJET PRINTING APPARATUS

BACKGROUND OF THE INVENTION

1. Field of the Invention

This invention relates to an inkjet printing apparatus, and more particularly to a technology of preventing a drop of ink from an ink leading-out needle, which is possibly generated at the time of pulling an ink tank out of an ink tank holder.

2. Description of the Related Art

As means of supplying ink to a print head in an inkjet printing apparatus, there is provided a pressure supply system of pressurizing the ink in an ink tank or an ink flow passage by a pump or a water head pressure to supply the pressurized ink to the print head.

According to this system, in a case where an amount of the ink in the ink tank is reduced or a quality assurance period of the ink is expired, an appropriate ink supply state can be recovered by replacing the ink tank.

On the other hand, in this system, the ink possibly drops at the time of pulling the ink tank out of the ink tank holder. That is, an ink leading-out needle, which can lead out the ink in the ink tank to the ink flow passage in the inkjet printing apparatus when the ink tank is mounted onto the ink tank holder, is provided at the ink leading-out portion of the ink tank or on the ink tank holder, wherein, the ink tends to easily drop from a tip end of the ink leading-out needle at pullout of the ink tank. This is because the ink between the ink tank and the ink tank holder is pulled and separated by each member to drop or the ink pooled in a tip end of each member drops due to an impact at pullout or the like.

For overcoming this problem, there is known a method where a pressurized pressure relief mechanism is activated to return an ink pressure in the ink flow passage back to an atmospheric pressure, and then the ink tank is pulled out, thus reducing an amount of the ink droplets. Also in this method, however, there are some cases where components such as resins or rubber constituting the ink flow passage, which are deformed or expanded by pressures, or metallic films will be back to original dimensions with time, and therefore a small deal of the ink drops from the ink leading-out needle after ink tank pullout.

When the ink thus drops, the ink is attached to the inside of the ink tank holder and is then attached to a housing peripheral portion of the ink tank. Therefore, there are some cases where hands of an operator get dirty or in a case where a pullout sensor is attached to the ink tank, an erroneous operation occurs. As the measure technology on this problem, there is known a method where a valve operable in association with pullout of the ink tank is provided in a printing apparatus body or a technology disclosed in Japanese Patent Laid-Open No. 2008-049640. In detail, in Japanese Patent Laid-Open No. 2008-049640, an absorbent is provided in the periphery of the ink leading-out portion of the ink tank and the dropped ink is retained by the absorbent. Therefore, there is no possibility that the hands of the operator get dirty.

However, the construction of providing the valve mechanism to the printing apparatus body leads to an increase in size or in cost of the printing apparatus. Further, the construction of providing the absorbent in the periphery of the ink leading-out portion of the ink tank as in the case of Japanese Patent Laid-Open No. 2008-049640 brings in an increase in cost due to the provision of the absorbent. In addition, there is a possibility of damaging sealing properties of a sealing member provided in the ink leading-out portion for preventing leakage of ink, due to dusts generated from the absorbent.

SUMMARY OF THE INVENTION

An object of the present invention is to provide an inkjet printing apparatus which can restrict ink droplets at ink tank pullout without damaging sealing properties of the ink tank or bringing in an increase in size or in cost of the printing apparatus.

For achieving this object, an inkjet printing apparatus according to the present invention comprises an ink tank including an ink accommodating unit for accommodating ink therein, an ink leading-out mechanism for leading out the ink accommodated in the ink accommodating unit to an outside, and a housing, and an ink tank holder for removably retaining the ink tank, wherein a space is formed between the ink leading-out mechanism and the housing in a mount direction of the ink tank to the ink tank holder, and when the ink tank is mounted to the ink tank holder, an ink flow passage is formed by contact of an outer periphery of an ink leading-out needle provided in the ink tank holder with a sealing member provided in the ink leading-out mechanism, further comprising restriction means for restricting a position of the ink tank to the ink tank holder such that at the time of removing the ink tank from the ink tank holder, the ink tank stops in a state where a tip end of the ink leading-out needle is in the space.

According to the present invention, there can be provided an inkjet printing apparatus which can restrict ink droplets at ink tank pullout without damaging sealing properties of the ink tank.

Further features of the present invention will become apparent from the following description of exemplary embodiments (with reference to the attached drawings).

DESCRIPTION OF THE EMBODIMENTS

Hereinafter, preferred embodiments according to the present invention will be explained with the accompanying drawings.

First Embodiment

Figure 1:
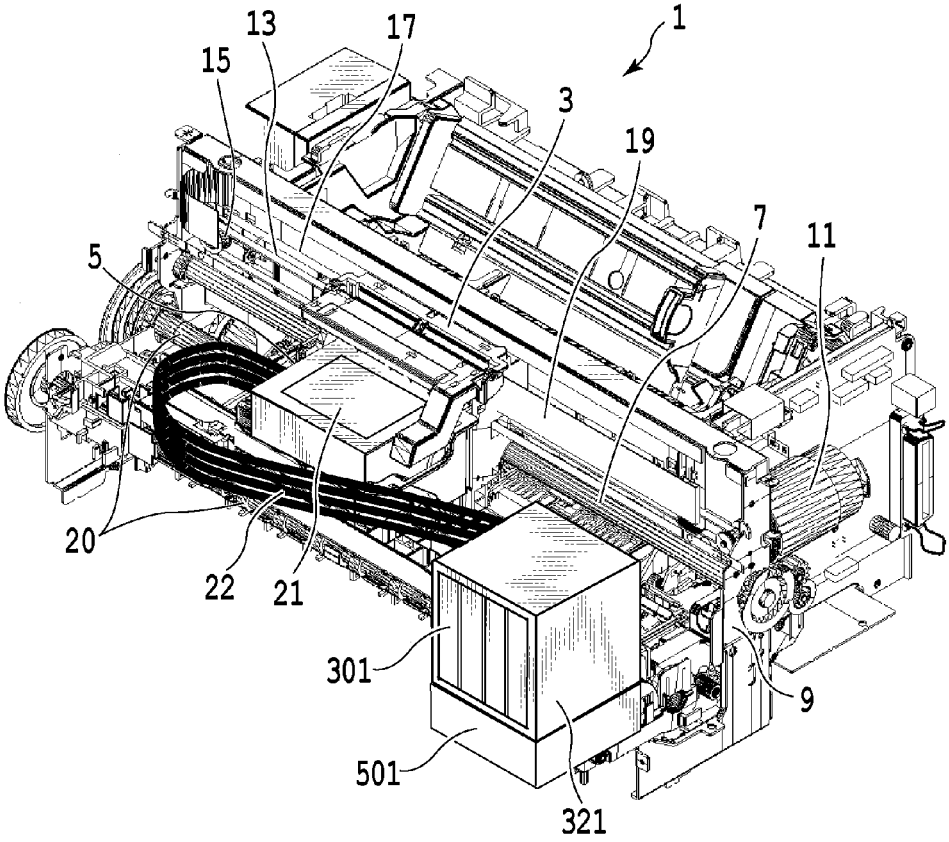
FIG. 1 is an outside appearance perspective view of an inkjet printing apparatus in a first embodiment according to the present invention.

FIG. 1 is an outside appearance perspective view of an inkjet printing apparatus in a first embodiment according to the present invention.

In FIG. 1, at 1 is indicated a printer engine. At 3 is indicated a carriage for mounting a print head 5 as print means thereon. The carriage 3 is slidably mounted on a guide shaft 7 for reciprocal scanning in a direction vertical to a conveyance direction of a print medium such as a sheet material. The carriage 3 is driven through a timing belt 13 by a carriage motor 11 mounted to a chassis 9. The timing belt 13 is tightened and supported by an idler pulley 15. A code strip 17 on which markings are formed by a pitch of 150 to 300 lpi for detecting a position of the carriage 3 is provided in parallel with the timing belt 13. Further, an encoder sensor (not shown) is mounted on the carriage 3 for reading the marking. The carriage 3 is provided with a flexible substrate 19 for transmitting a signal from an electrical substrate (not shown) to the print head 5.

In the above construction, at the time of forming an image on the sheet material as the print medium, a conveyance roller pair 20 conveys the sheet material to a row position (position in the conveyance direction of the sheet material) for forming the image. The carriage 3 scans while facing the sheet material by the carriage motor 11. When the carriage 3 scans a column position (position perpendicular to the conveyance direction of the sheet material) for forming the image, ink is ejected toward the sheet material from ejection openings of the print head 5 in response to a signal from the electrical substrate to form the image.

At 21 is indicated a sub tank unit integral with the print head 5. One sub tank per ink kind is accommodated in the sub tank unit 21. The present embodiment is constructed such that a print can be performed by ink of four colors composed of black, cyan, magenta, and yellow, and therefore four sub tanks are provided.

At 22 is indicated ink supply tubes composed of polyethylene, elastomer or the like, which form ink flow passages between an ink tank 301 and the print head 5.

At 321 is indicated an ink tank holder for removably holding the ink tank 301 therein, which serves as connection between a flow passage of air pressure-fed from a pressure pump described later and the ink supply tube 22 for supplying the ink to the print head 5.

At 501 is indicated a pressure pump unit as air pressure means.

Figure 2:
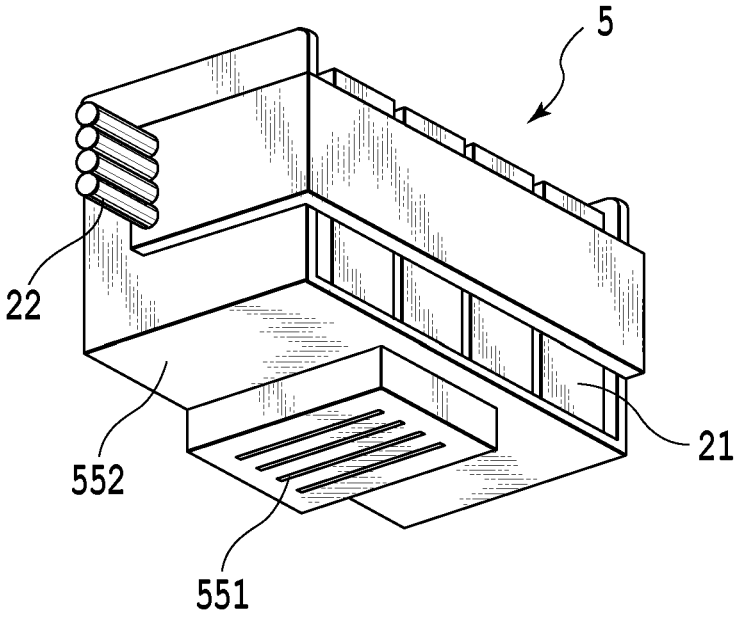
FIG. 2 is a schematic perspective view of a print head in the first embodiment according to the present invention.

FIG. 2 is an outside appearance perspective view of the print head 5 as print means. At 551 is indicated a chip unit provided with ink ejection openings. At 552 is indicated a chip tank forming an ink flow passage between the chip and the sub tank, which is configured to be capable of being fixed to the carriage.

Figure 3:
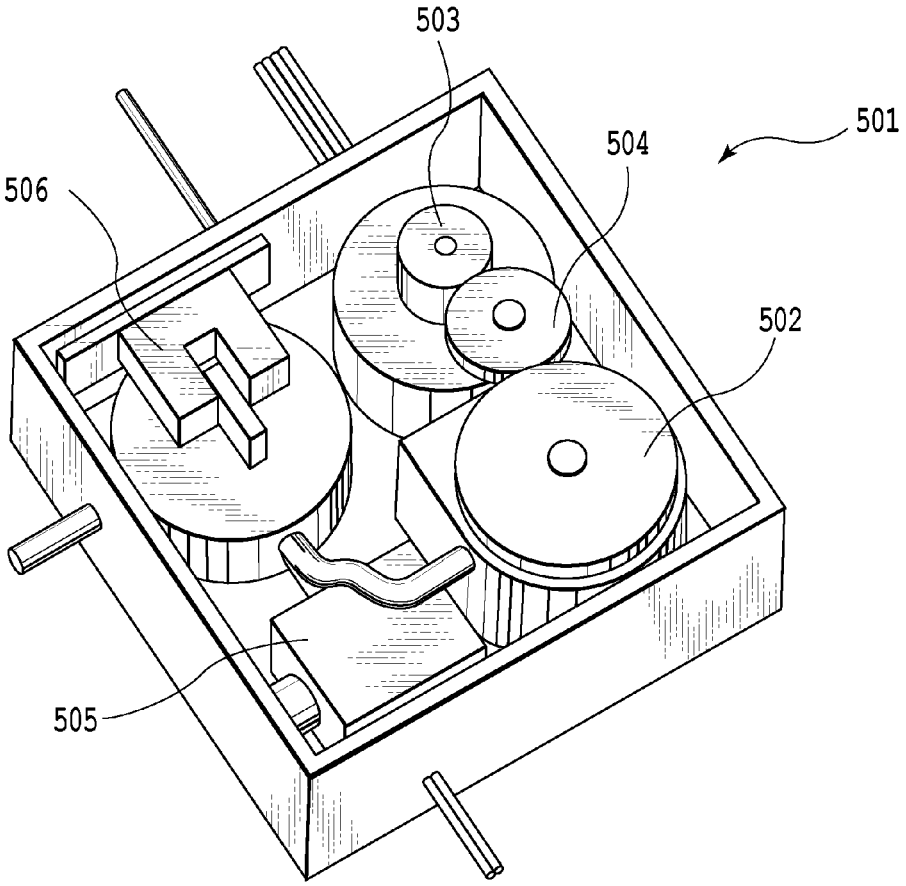
FIG. 3 is a schematic perspective view of a pressure pump in the first embodiment according to the present invention.

FIG. 3 is an outside appearance perspective view of the pressure pump unit 501. By referring to FIG. 3, there will be explained a supply system by air pressurization which feeds ink to the print head by pressure-feeding the air into the ink tank, which is adopted in the present embodiment.

The pressure pump unit 501 is provided with a pressure pump 502 formed of a tube pump, a pressure pump motor 503 as drive means, and a drive gear train 504. At 505 is indicated a solenoid valve for closing a portion between a pressurized air flow passage and atmospheric air only during voltage applying.

At 506 is indicated a pressure sensor as pressure detecting means. The pressure sensor 506 is provided with a diaphragm composed of rubber and a spring, and a photo interrupter of a transparent type for detecting a displacement of the diaphragm. The pressure sensor 506 detects a pressure in an air flow passage for feeding air to an air chamber 317 (described later in FIG. 7) provided in the ink tank 301 from the pressure pump 502 in the pressure pump unit 501 and determines whether the pressure is higher or lower than a predetermined pressure value.

Figure 4:
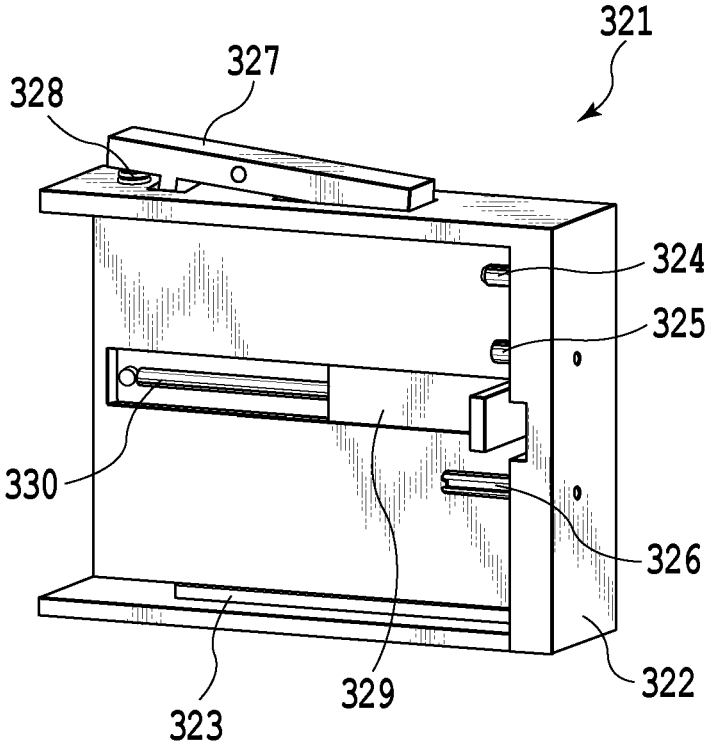
FIG. 4 is an outside appearance perspective view of an ink tank holder in the first embodiment according to the present invention.

FIG. 4 is a perspective view of a unit corresponding to one ink tank in an ink tank holder 321 removably holding the ink tank therein described later. It should be noted that in the present embodiment, since the ink tanks of four colors can be mounted, four ink tank holders are provided.

At 325 is indicated an air supply needle for pressure-feeding the pressurized air generated in the pressure pump unit 501 to the air chamber 317 provided in the ink tank 301. At 326 is indicated an ink leading-out needle for leading out the ink led out from the ink tank to the printing apparatus body. At 324 and at 323 are indicated a positioning projection (324) and a positioning guide rib (323) for accurately positioning the ink tank 301 and the ink tank holder 321 at the time when the ink tank 301 is mounted to the ink tank holder 321 in such a manner as to be printable. At 322 is indicated a flow passage member in which flow passages of the pressurized air and the ink are formed.

At 327 and at 328 are indicated a lock lever (327) and a lock lever spring (328) operated by a user for pullout of the ink tank.

At 329 and at 330 are indicated an ejector (329) and an ejector spring (330) urging the ink tank in a direction (pullout direction) of releasing the mount state between the ink tank 302 and the ink tank holder 321.

Figure 5:
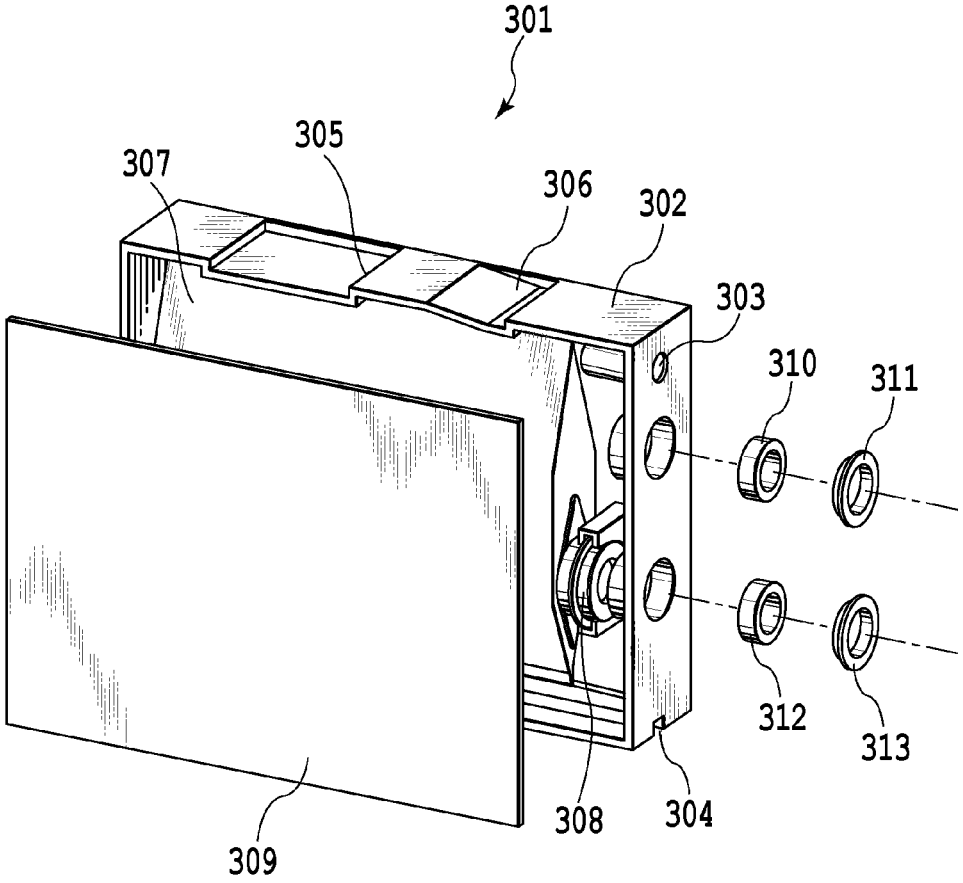
FIG. 5 is an exploded perspective view showing the construction of an ink tank in the first embodiment according to the present invention.

FIG. 5 is an exploded perspective view of the ink tank 301. The ink tank housing is formed by thermally bonding the ink tank case 302 and an ink tank cover 309 at an entire periphery of an outer peripheral portion of each, and an ink bag 307 as an ink accommodating unit for accommodating the ink is provided in the ink tank housing.

A positioning hole 303 and a guide groove 304 are provided in the ink tank case 302 for aligning a position of the positioning projection 324 and a position of the positioning guide rib 323 of the ink tank holder 321. At 310 is indicated a first air sealing rubber into which the air supply needle 325 for introducing pressurized air is inserted and which prevents air leakage. At 311 is indicated a first air sealing rubber cap melted and fixed to the ink tank case 302 for fixing the air sealing rubber 310. At 312 is indicated a second air sealing rubber into which the ink leading-out needle 326 is inserted and which prevents the air leakage. At 313 is indicated a second air sealing rubber cap melted and fixed to the ink tank case 302 for fixing the second air sealing rubber 312.

At 308 is indicated an ink leading-out mechanism which is formed integrally with the ink bag 307 and to which the ink leading-out needle 326 is connected for leading out the ink accommodated in an inside of the ink bag 307 to an outside of the ink bag 307. A rubber seal and a valve, which will be described later, are provided in the ink leading-out mechanism 308. At 306 is indicated a lock groove for maintaining a mount state of the ink tank 301 at the time the ink tank 301 is inserted into and mounted onto the ink tank holder 321. At 305 is indicated a protrusion preventive groove as restriction means for restricting a position of the ink tank 301 in such a manner as to prevent the ink tank 301 from protruding from the ink tank holder 321 over a predetermined amount at the operation of releasing the mount state of the ink tank 301 to the ink tank holder 321.

FIG. 6 to FIG. 9B are diagrams each explaining a function of the present invention at the time of mounting/removing the ink tank 301 to/from the ink tank holder 321.

Figure 6:
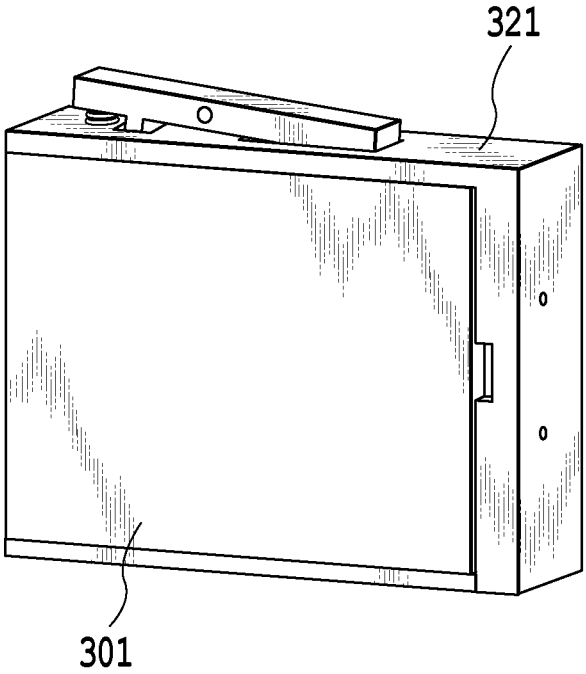
FIG. 6 is an outside appearance perspective view showing a mount state of the ink tank in the first embodiment according to the present invention.
Figure 7:
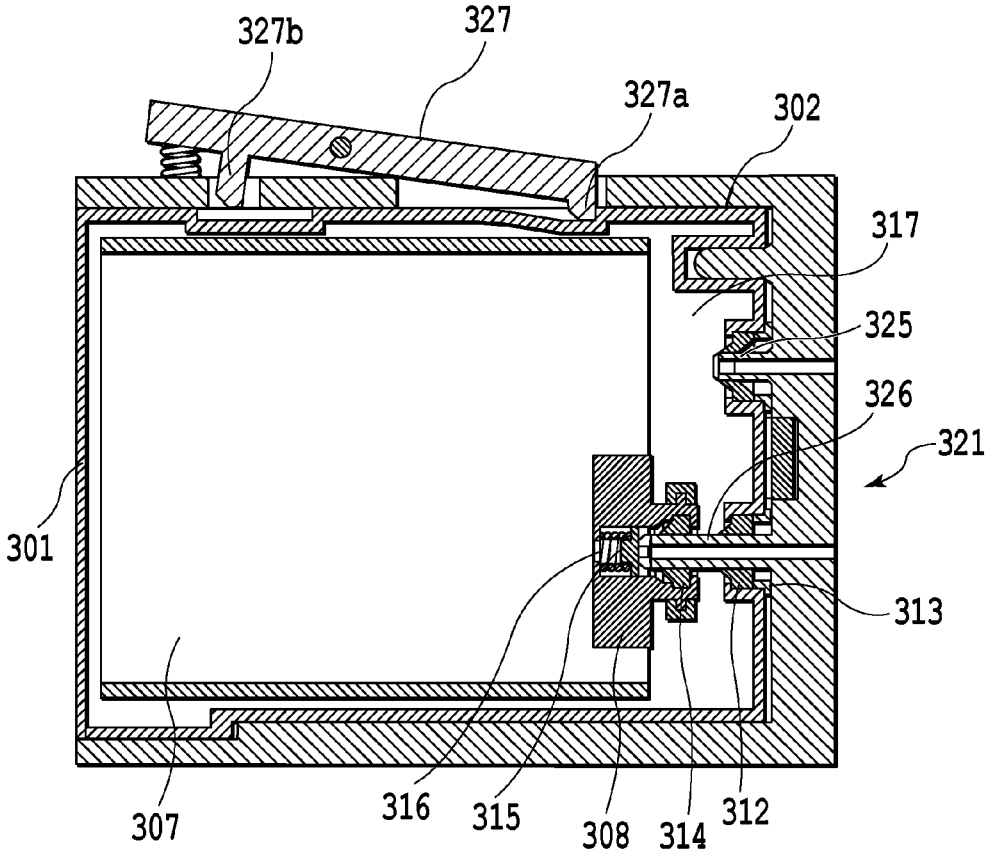
FIG. 7 is a cross section showing the mount state of the ink tank in the first embodiment according to the present invention.

FIG. 6 and FIG. 7 are an outside appearance perspective view and a cross section each showing the mount state of the ink tank 301 and the ink tank holder 321 in the first embodiment.

Herein at 314 in FIG. 7 is indicated an ink sealing rubber as a sealing member, which is housed in the ink leading-out mechanism 308, for securing a state in close contact with the ink leading-out needle 326. The ink sealing rubber 314 is arranged to be in contact with an outer periphery of the ink leading-out needle 326 in the mount state of the ink tank 301 and the ink tank holder 321. At 315 and at 316 are indicated a valve (315) which turns into an open state by inserting the ink leading-out needle 326 into the ink leading-out mechanism 308 and an urging spring (316) for urging the valve (315) to the ink sealing rubber 314. In this state, communication between the ink flow passage of the ink leading-out needle 326 and the ink bag 307 of the ink tank 301 is formed.

According to the above construction, when the ink tank 301 is inserted into the ink tank holder 321, a lock nail 327*a* provided in the lock lever 327 is engaged with the lock groove 306 provided in the ink tank case 302. Therefore, the mount state between the ink tank 301 and the ink tank holder 321 is formed and maintained.

When the ink tank 301 is inserted into the ink tank holder 321, the air chamber 317 as a space between the housing (ink tank case 302 and ink tank cover 309) of the ink tank 301 and the ink bag 307 is formed as a closed space. The air chamber 317, as exemplified in FIG. 7, typically exists in the ink tank 301 in a mount direction thereof to the ink tank holder 321. When pressurized air is pressure-fed from the air supply needle 325 to the air chamber 317, the ink bag 307 is compressed to supply the ink accommodated in the ink bag 307 to the printing apparatus body.

Next, the control and state at the time of replacing the ink tank 301 will be explained.

FIG. 6 and FIG. 7 show the mount state between the ink tank 301 and the ink tank holder 321. Before releasing this mount state to pull the ink tank 301 out of the ink tank holder 321, first, the solenoid valve 505 is opened to open an inside of the air chamber 317 to an atmosphere, thus eliminating a pressure difference among the air chamber 317, the inside of the ink bag 307 and the atmosphere. In consequence, the expanded housing of the ink tank 301 and the expansion or the deformation of the member such as the resin constituting the ink flow passage are back to the previous state. Therefore, even if the ink tank 301 is pulled out of the ink tank holder 321, a large deal of ink is prevented from being ejected from the ink leading-out needle 326 to drop.

Figure 8:
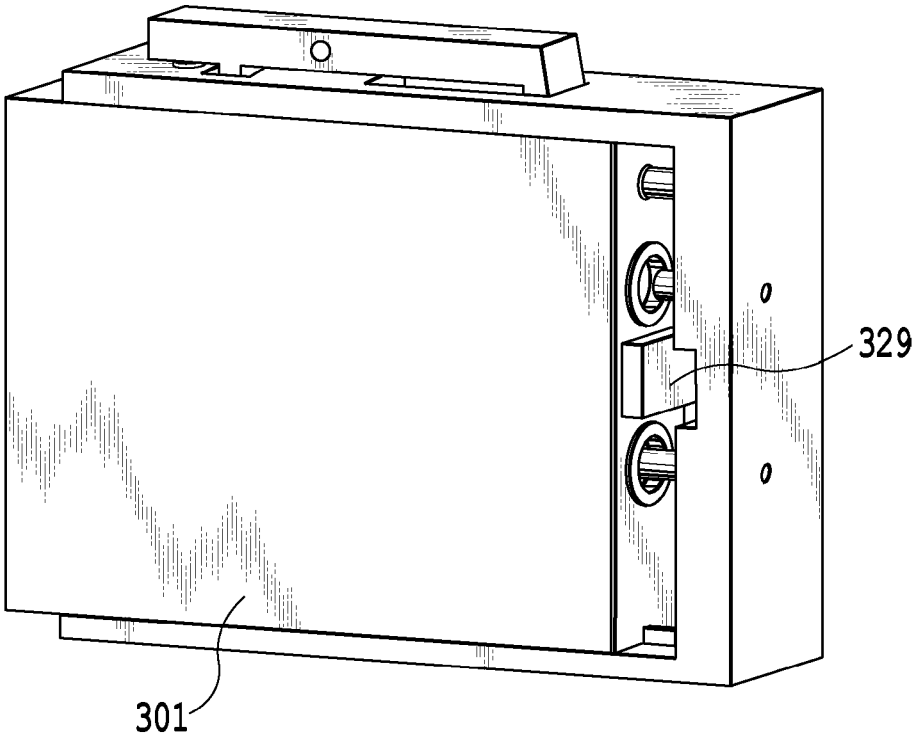
FIG. 8 is an outside appearance perspective view showing an unlocked state of the ink tank in the first embodiment according to the present invention.
Figure 9A:
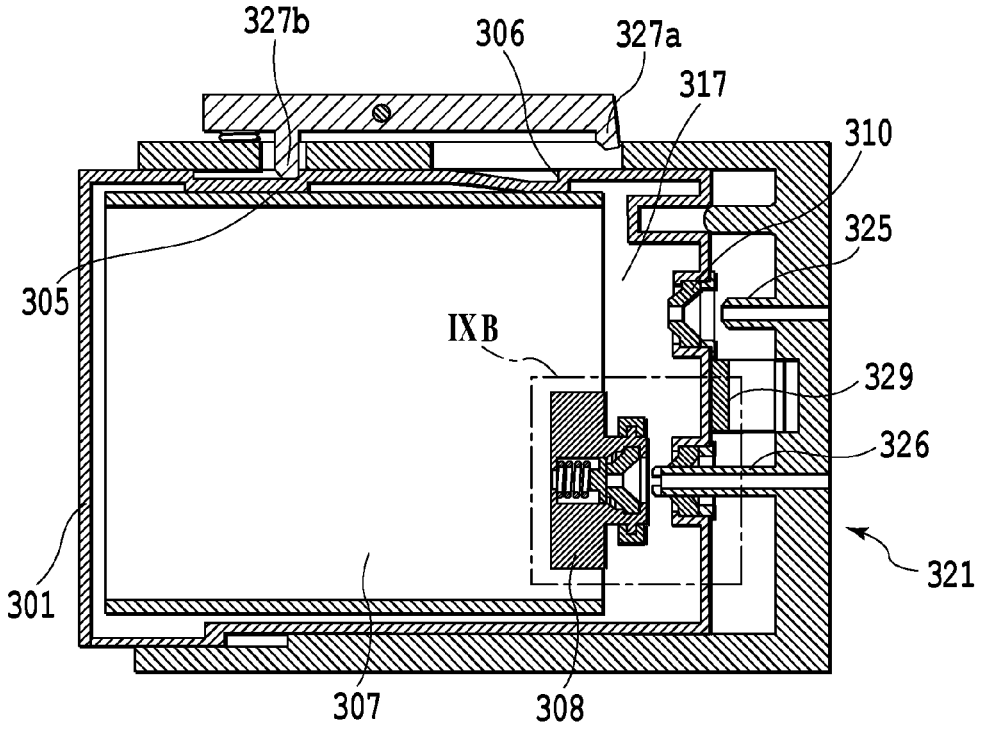
FIG. 9A and FIG. 9B are cross sections each showing the unlocked state of the ink tank in the first embodiment according to the present invention.

Subsequently the lock lever 327 is operated in such a manner as to be in a state as shown in FIG. 8 and FIG. 9A to release the engagement between the lock nail 327*a* and the lock groove 306. Then, the ink tank 301 is pushed out in the pullout direction of the left direction in the figure by functions of an ejector 329 and an ejector spring 330, and stops in a position where the protrusion preventive nail 327*b* provided in the lock lever 327 and the protrusion preventive groove 305 are engaged. It should be noted that, since the movement of the ejector 329 is designed to stop in a position as shown in the figures, even if an operator releases his hand from the lock lever 327 immediately at this state, there is no possibility that the ink tank 301 protrudes furthermore from the position shown in the figure. In this manner, the movement stop position of the ink tank 301 at the time of releasing the locked state can be set by the position restricting means such as the protrusion preventive mechanism and the ejector mechanism as mentioned above.

In this movement stop position, for example, an opening portion as a tip end of the air supply needle 325 is separated in its entirety from the first air sealing rubber 310, and the air chamber 317 is in an atmosphere open state. Therefore, even if the mount state between the ink tank 301 and the ink tank holder 321 is released in a state where the solenoid valve 505 is not opened, there is no possibility that a large deal of ink is abnormally ejected from the ink leading-out needle 326.

Figure 9B:
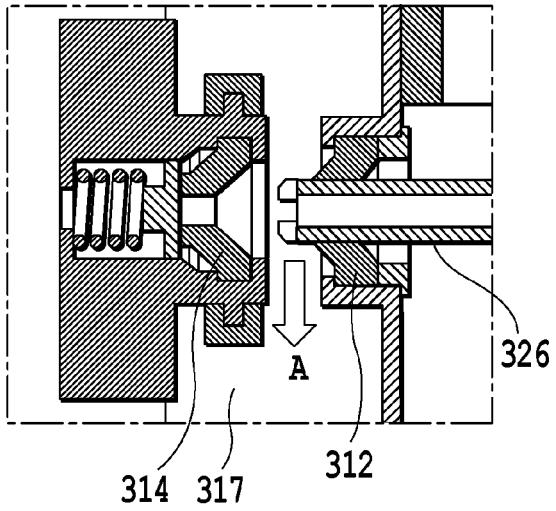

By referring to FIG. 9B, in this movement stop position, the tip end of the ink leading-out needle 326 is positioned in the air chamber 317 between the ink sealing rubber 314 and the second air sealing rubber 312. The leading-out needle 326 is wiped out by the ink sealing rubber 319 pressed against the outer periphery in a period between the unlocked state and the movement stop of the ink tank 301. However, there are some cases where the ink which is left without being wiped out by the ink sealing rubber 314 is attached on the tip end of the ink leading-out needle 326 positioned in the air chamber 317. In addition, there are some cases where a small deal of ink pushed out by the deformation of the ink flow passage in the printing apparatus body after releasing the mount state between the ink tank 301 and the ink tank holder 321 is attached on the ink leading-out needle 326. On the other hand, in the present embodiment, the movement of the ink tank 301 is stopped in such a manner that the tip end of the ink leading-out needle 326 is arranged in the air chamber or the space of the ink tank at the movement stop position by the above lock releasing operation. According to this construction, the ink pulled out and separated by the respective members at the time the contact between the ink leading-out needle and the ink sealing rubber is eliminated or the ink dropped by vibrations generated due to the lock releasing can be dropped in the air chamber in the direction of an arrow A in the figure. Therefore, at the time of pulling the ink tank 301 in the movement stop position out of the ink tank holder 321, the ink can be in a state of being not nearly attached on the ink leading-out needle 326. In addition, even if the ink is attached thereon, the ink can be wiped furthermore out by the second air sealing rubber 312 pressed against the outer periphery of the ink leading-out needle in a period where the tip end of the ink leading-out needle moves from the movement stop position to the outside of the ink tank. In this manner, the construction of the present embodiment can reduce the possibility that due to the pullout of the ink tank 301, the ink drops from the ink leading-out needle 326 of the ink tank holder 321 or the ink drops from the circumference of the second air sealing rubber cap of the ink tank 301.

Second Embodiment

Figure 10A:
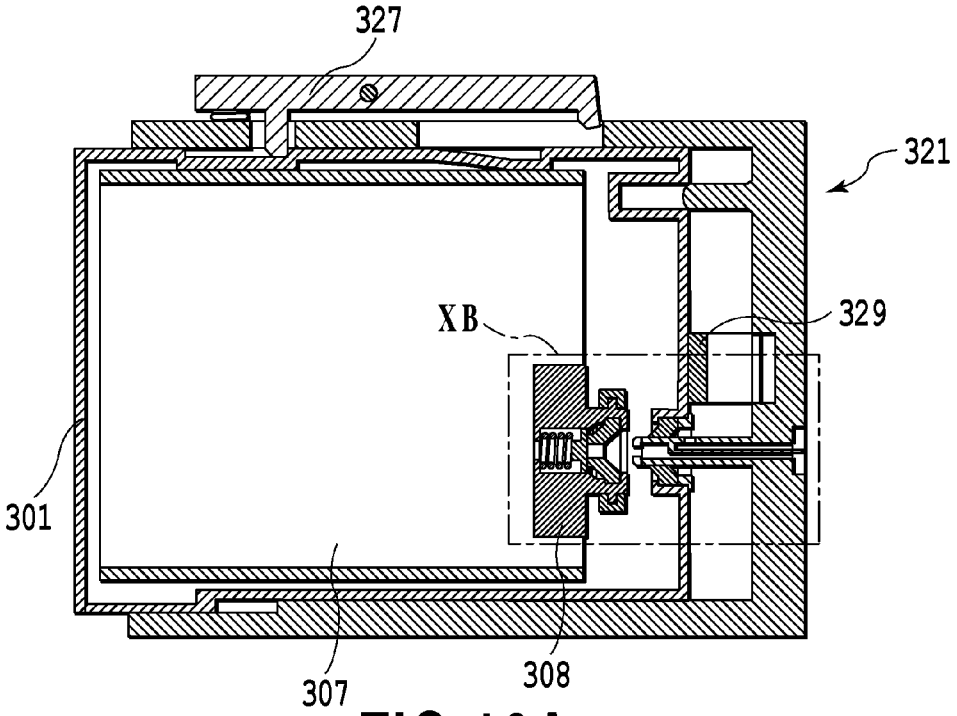
FIG. 10A and FIG. 10B are cross sections each showing an unlocked state of an ink tank in a second embodiment according to the present invention.
Figure 10B:
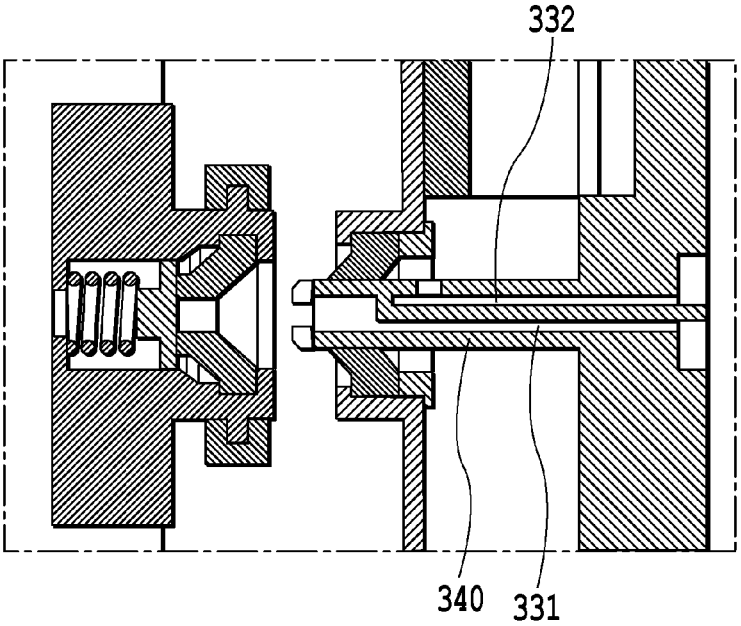

FIG. 10A and FIG. 10B are cross sections each showing an unlocked state between an ink tank 301 and an ink holder 321 in a second embodiment according to the present invention.

In the present invention, the ink leading-out needle and the air supply needle are not necessarily constructed as separated members as in the case of the first embodiment. For example, as shown in FIG. 10B, an ink supply passage 331 and an air supply passage 332 may be constructed coaxially with or along an axis of a single ink leading-out needle 340. In the second embodiment thus constructed, the furthermore space-saving construction is possible. Since other components in the second embodiment are similar to those in the first embodiment, the explanation herein is omitted.

Further, the present invention is not necessarily required to be provided with the air supply needle. For example, an ink pressure-feeding pump may be provided in the ink flow passage or there may be used a water head difference system of pulling up the ink from the ink tank provided in a position lower than the print head by a negative pressure due to ink consumption of the print head without use of the pressure pump. In these cases, the air chamber is not required to be pressurized inside, and therefore serves only as a space for performing collection of the dropped ink.

The pullout mechanism of the ink tank is not necessarily provided with the exclusive lock lever, and for example, may be associated with an opening/closing operation of a lid member for covering the ink tank.

Further, an absorbent may be provided in the ink tank to maintain the dropped ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-194138, filed Aug. 31, 2010, which is hereby incorporated by reference herein in its entirety.

What is claimed is:

1. An inkjet printing apparatus comprising:

an ink tank comprising:

an ink accommodating unit for accommodating ink therein, an ink leading-out mechanism connected to the ink accommodating unit and constructed to lead out the ink accommodated in the ink accommodating unit, and an ink tank housing constructed to house the ink accommodating unit and the ink leading-out mechanism, and provided with an opening therein, wherein the ink leading-out mechanism and the opening are spaced apart from each other with an inner space of the housing therebetween; and an ink tank holder constructed to removably retain the ink tank, the ink tank holder including an ink leading out-needle, wherein when the ink tank is mounted to the ink tank holder, an ink flow passage is formed by the ink leading-out needle passing through the opening such that an outer periphery of the ink leading-out needle contacts a sealing member provided in the ink leading-out mechanism, and wherein the ink tank further comprises a restriction portion for restricting a position of the ink tank relative to the ink tank holder such that at a time of removing the ink tank from the ink tank holder, the ink tank stops in a state where a tip end of the ink leading-out needle is in the inner space.

2. An inkjet printing apparatus according to claim 1, wherein the ink tank further comprises a second sealing member disposed so as to contact an outer periphery of the ink leading-out needle during a period when the tip end of the ink leading-out needle moves from a position within the inner space, corresponding to a position where the restriction portion stops the ink tank, to a position outside of the ink tank.

3. An inkjet printing apparatus according to claim 1, wherein the ink tank is constructed such that the ink is led out to an outside of the ink accommodating unit by supplying air to the inner space.

4. An inkjet printing apparatus according to claim 1, wherein the ink leading-out needle coaxially includes an air supply passage for supplying air to the inner space.

5. An inkjet printing apparatus according to claim 1, wherein the restriction portion is an indented portion of the ink tank housing.

6. An inkjet printing apparatus according to claim 5, wherein the restriction portion is disposed on a top surface of the ink tank housing.

7. An ink tank comprising:

an ink accommodating unit for accommodating ink therein;

an ink leading-out mechanism connected to the ink accommodating unit and constructed to lead out the ink accommodated in the ink accommodating unit;

an ink tank housing constructed to house the ink accommodating unit and the ink leading-out mechanism, and provided with an opening therein, wherein the ink leading-out mechanism and the opening are spaced apart from each other with an inner space of the ink tank housing therebetween, and wherein the ink tank housing includes a restriction portion disposed on a surface of the ink tank housing.

8. An ink tank according to claim 7, wherein the restriction portion is an indented portion of the ink tank housing.

9. An ink tank according to claim 8, wherein the restriction portion is disposed on a top surface of the ink tank housing.

* * * * *